US008516681B2

(12) United States Patent
Kuze et al.

(10) Patent No.: US 8,516,681 B2
(45) Date of Patent: Aug. 27, 2013

(54) LOUD SPEAKER MANUFACTURING METHOD

(75) Inventors: Mitsukazu Kuze, Mie (JP); Takehiko Tanabu, Mie (JP); Satoshi Itoh, Mie (JP); Masashi Kawabe, Mie (JP); Mamiko Tsutsumi, Mie (JP)

(73) Assignee: Panasonic Corporation, Osaka (JP)

( * ) Notice: Subject to any disclaimer, the term of this patent is extended or adjusted under 35 U.S.C. 154(b) by 67 days.

(21) Appl. No.: 13/057,048

(22) PCT Filed: Oct. 20, 2009

(86) PCT No.: PCT/JP2009/005474

§ 371 (c)(1),
(2), (4) Date: Feb. 1, 2011

(87) PCT Pub. No.: WO2010/050145

PCT Pub. Date: May 6, 2010

(65) Prior Publication Data

US 2011/0135138 A1 Jun. 9, 2011

(30) Foreign Application Priority Data

Oct. 27, 2008 (JP) ..... 2008-275115
Nov. 18, 2008 (JP) ..... 2008-294124
Nov. 18, 2008 (JP) ..... 2008-294125

(51) Int. Cl.
*H04R 31/00* (2006.01)

(52) U.S. Cl.
USPC ..... 29/594; 29/592.1; 29/595; 29/609.1; 29/729; 381/120; 381/182; 381/396; 381/398

(58) Field of Classification Search
USPC ..... 29/592.1, 594, 609.1; 181/157, 181/166, 167, 171–173; 381/120, 182, 396, 381/398, 403, 423, 426, 429, 430
See application file for complete search history.

(56) References Cited

U.S. PATENT DOCUMENTS 4,122,314 A * 10/1978 Matsuda et al. ..... 381/425
5,062,140 A * 10/1991 Inanaga et al. ..... 381/399
5,521,886 A * 5/1996 Hirosawa et al. ..... 367/174

(Continued)

FOREIGN PATENT DOCUMENTS

CN 2800682 Y 7/2006
CN 1961608 A 5/2007

(Continued)

OTHER PUBLICATIONS

JP Office for 2008-294125 dated Oct. 2, 2012.

(Continued)

*Primary Examiner* — Paul D Kim
(74) *Attorney, Agent, or Firm* — RatnerPrestia

(57) ABSTRACT

In a loud speaker, the diaphragm has a protruded part protruding on a yoke side on the inside and in the vicinity of an inner coupling part as a coupled portion to a voice coil. The loud speaker can be manufactured with the voice coil accurately positioned with respect to a diaphragm, and the voice coil is accurately vibrated vertically inside a magnetic gap. The possibility of the voice coil coming into contact with a plate and a yoke as a magnetic circuit body of the loud speaker can be reduced, thereby to improve production efficiency and a yield at the time of manufacturing the loud speaker.

7 Claims, 18 Drawing Sheets

(56) References Cited

U.S. PATENT DOCUMENTS

| | | | | |
|---|---|---|---|---|
| 6,691,832 | B2 * | 2/2004 | Moritake et al. | 181/153 |
| 7,184,567 | B2 * | 2/2007 | Sugata et al. | 381/433 |
| 7,324,659 | B2 | 1/2008 | Funahashi et al. | |
| 7,548,632 | B2 * | 6/2009 | Fukuyama et al. | 381/429 |
| 7,877,856 | B2 * | 2/2011 | Fukuyama et al. | 29/594 |
| 8,160,292 | B2 * | 4/2012 | Sano et al. | 381/420 |
| 2001/0017928 | A1 | 8/2001 | Sugiyama et al. | |
| 2004/0075351 | A1 * | 4/2004 | Ueda et al. | 310/81 |
| 2004/0228500 | A1 * | 11/2004 | Stiles | 381/398 |
| 2005/0078849 | A1 | 4/2005 | Funahashi et al. | |
| 2008/0063235 | A1 | 3/2008 | Takewa | |

FOREIGN PATENT DOCUMENTS

| | | | | |
|---|---|---|---|---|
| JP | 61-005698 | A | | 1/1986 |
| JP | 62-183494 | | | 11/1987 |
| JP | 62-278896 | A | | 12/1987 |
| JP | 5-70097 | U | | 9/1993 |
| JP | 08223699 | A | * | 8/1996 |
| JP | 2000-156898 | A | | 6/2000 |
| JP | 2001-245388 | A | | 9/2001 |
| JP | 2001-298799 | A | | 10/2001 |
| JP | 2002-199497 | A | | 7/2002 |
| JP | 2003-037895 | A | | 2/2003 |
| JP | 2005-123663 | A | | 5/2005 |
| JP | 2005-323096 | A | | 11/2005 |
| JP | 2006-229657 | A | | 8/2006 |
| JP | 2007-288601 | A | | 11/2007 |
| JP | 2007-336145 | A | | 12/2007 |
| JP | 2008-113367 | A | | 5/2008 |
| JP | 2008-131180 | A | | 6/2008 |

OTHER PUBLICATIONS

JP Office Action for 2008-294124 dated Sep. 25, 2012.
JP Office Action for 2008-275115 dated Oct. 2, 2012.
International Search Report for PCT/JP2009/005474, Jan. 19, 2010.
CN Office Action for 200980142243.6, Apr. 3, 2013.

* cited by examiner

LOUD SPEAKER MANUFACTURING METHOD

This application is a U.S. National Phase Application of PCT International Application PCT/JP2009/005474.

TECHNICAL FIELD

The present invention relates to a loud speaker, a loud speaker manufacturing method, and a loud speaker manufacturing jig.

BACKGROUND ART

Conventionally, in assembling constitutional components at the time of manufacturing a loud speaker, an operation has generally been difficult to perform mechanically, and has been dependent upon a skilled manual operation.

However, recent loud speakers with reduced size and thickness have been increasingly affected by displacement of components due to the manual operation, thereby decreasing a yield.

Especially when a magnet as one of the constituent components of the loud speaker is reduced in size in accordance with the reduced size and thickness of a loud speaker body, the yield decrease is obvious Specifically, when the magnet is reduced in size, a gap between a plate and a yoke is required to be narrowed for compensating deterioration in performance due to the size reduction, but it has been difficult in the manual operation to accurately dispose respective magnetic circuit components of the plate, the yoke and the magnet which constitute a magnetic circuit body of the loud speaker, and a voice coil may come into contact with the plate and the yoke, leading to the yield decrease.

To approach this problem, there is described in Patent Document 1 a loud speaker manufacturing method where each magnetic circuit component is accurately disposed by use of a jig to allow the gap narrowing.

FIGS. 18A to 18D are views showing a conventional loud speaker manufacturing method. In the manufacturing method described in Patent Document 1, as shown in FIGS. 18A to 18D, plate 103, magnet 104 and yoke 105 are sequentially piled up using first jig 101 and second jig 102, to manufacture a magnetic circuit body of the loud speaker. This can result in such accurate disposition that magnet 104 is placed at a center of yoke 105, and further, a center axis of magnet 104 and a center axis of plate 103 are placed on the same axis.

The conventional manufacturing method described in Patent Document 1 has a problem of decreased production efficiency caused by the use of two different jigs of first jig 101 and second jig 102.

Further, in the case of the voice coil being unable to accurately perform vertical vibration inside the narrowed magnetic gap, the voice coil comes into contact with the plate and the yoke at the time of driving the loud speaker, and the yield may thereby decrease.

PRIOR ART DOCUMENT

Patent Document

[Patent Document 1] Unexamined Japanese Patent Publication No. 2007-336145

DISCLOSURE OF THE INVENTION

A loud speaker manufacturing method according to the present invention is a loud speaker manufacturing method for which a jig provided with a guide member having linear guide portions is used. The manufacturing method includes the steps of mounting a frame on the jig, and guiding part of a yoke notched part provided in a yoke by the guide member of the jig, and coupling the yoke to the frame. Further, the manufacturing method includes a step of guiding part of a plate notched part provided in a plate joined with a magnet by the guide member of the jig, and coupling the magnet to the yoke.

With the present manufacturing method, it is possible to manufacture a magnetic circuit body portion of the loud speaker by use of only one jig, and consequently provide a loud speaker manufacturing method with excellent production efficiency.

Further, the loud speaker according to the present invention includes a frame having an opening, a yoke coupled to an inner periphery of the frame, and having a bottom surface in substantially rectangular shape, a magnet coupled to a bottom center of the yoke, and having a substantially rectangular shape, and a plate coupled to a surface of the magnet on an opposite side to a coupled surface to the yoke, and having a substantially rectangular shape. Moreover, the loud speaker has a diaphragm with an outer periphery thereof coupled to the frame, and a voice coil, which is coupled to a bottom surface of the diaphragm, and part of which is disposed inside a magnetic gap between the yoke and the plate. The diaphragm has a protruded part protruding on the yoke side on an inside and in a vicinity of a coupled portion to the voice coil.

According to the structure of the loud speaker of the present invention, at the time of manufacturing the loud speaker, the protruded part provided in the diaphragm is inserted into the inner periphery of the voice coil such that the outer peripheral surface of the protruded part is placed along the inner peripheral surface of the voice coil, thereby allowing accurate positioning of the voice coil mounted on a voice coil mounting part with respect to a predetermined position of the diaphragm. This can result in reduced possibility of the voice coil coming into contact with the plate and yoke, so as to improve a yield of the loud speaker.

A jig according to the present invention is a jig used for manufacturing a loud speaker having a yoke notched part and a plate notched part, the jig includes a guide member having a linear first guide portion which guides the yoke notched part and the plate notched part.

The linear first guide portion of the guide member provided in the jig is made to guide part of the notched part of each magnetic circuit component, and each magnetic circuit component is sequentially loaded, thereby allowing manufacturing of a magnetic circuit body portion of the loud speaker. It is possible to manufacture the magnetic circuit body portion of the loud speaker by use of only one jig, so as to manufacture a loud speaker with excellent productivity.

PREFERRED EMBODIMENTS FOR CARRYING OUT THE INVENTION

Hereinafter, embodiments of the present invention are described with reference to drawings.

An overall configuration of loud speaker 1 and jig 2 of the present embodiment is described with reference to FIG. 1.

Figure 1:
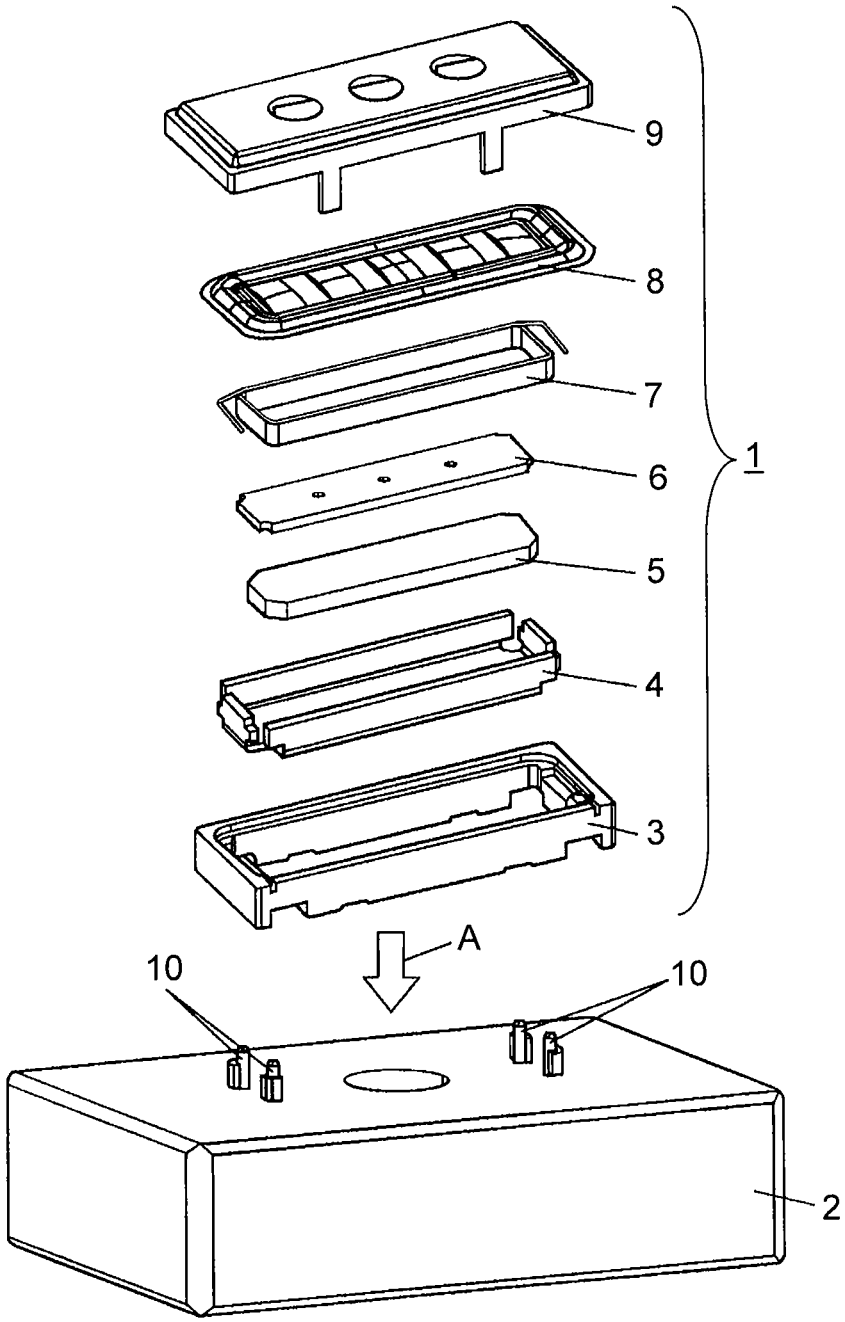
FIG. 1 is an exploded perspective view showing components provided in loud speaker 1, and jig 2.

FIG. 1 is an exploded perspective view showing components provided in loud speaker 1, and jig 2. In the present embodiment, a vertical relation shown in FIG. 1 is a vertical relation at the time of actually manufacturing loud speaker 1.

As shown in FIG. 1, loud speaker 1 includes frame 3, yoke 4, magnet 5, plate 6, voice coil 7, diaphragm 8, and protector 9. Among them, yoke 4 and plate 6 have notched parts on the peripheries thereof, and these yoke 4, plate 6 and magnet 5 form a magnetic circuit.

Further, jig 2 used for manufacturing this loud speaker 1 is provided with four guide members 10.

In the present embodiment, constitutional components of loud speaker 1 are guided in a direction of arrow A indicated in FIG. 1 by guide members 10 of this jig and sequentially loaded, to manufacture loud speaker 1.

Next, each of the constitutional components of loud speaker 1 is described.

Figure 2A:
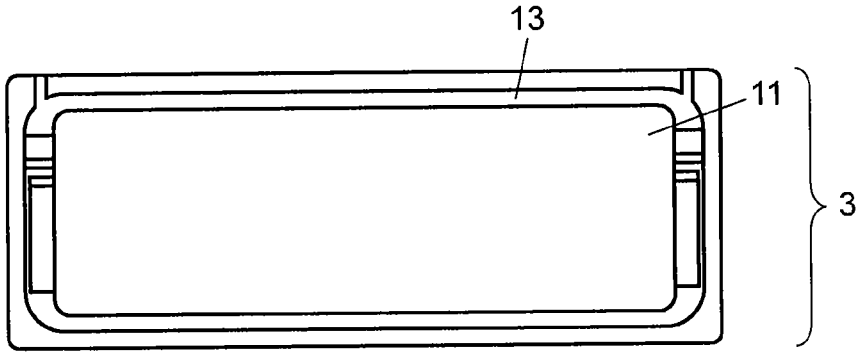
FIG. 2A is a top view of an outer appearance of frame 3.

First, frame 3 is described with reference to FIGS. 2A to 2D. FIG. 2A is a top view of an outer appearance of frame 3, FIG. 2B is a bottom view thereof, FIG. 2C is a front view thereof, and FIG. 2D is a side view thereof.

Frame 3 is made of a resin, and as shown in FIG. 2A, frame 3 has a substantially rectangular parallelepiped shape. As shown in FIG. 2A, an upper surface of frame 3 is in substantially rectangular shape made up of long side portions and short side portions, and each corner portion of the outer periphery has been chamfered.

Figure 2B:
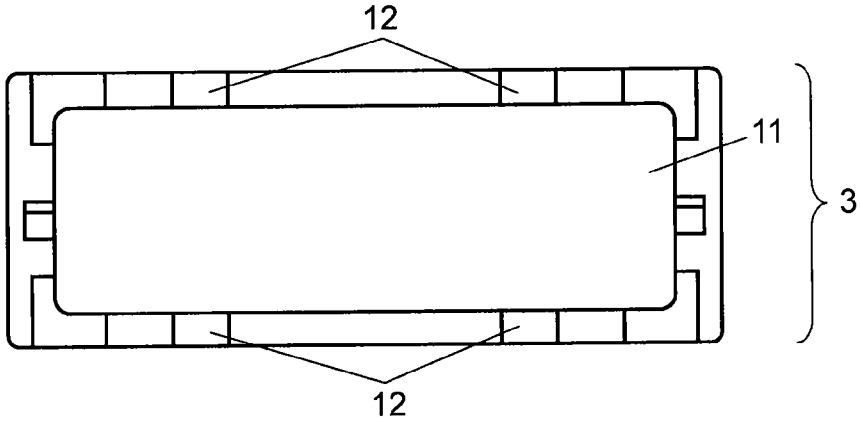
FIG. 2B is a bottom view of frame 3.

Further, as shown in FIGS. 2A and 2B, opening 11 in substantially rectangular shape is provided at the center of frame 3, and each corner part of opening 11 is in round shape. Opening 11 is a portion where yoke 4 is inserted at the time of manufacturing loud speaker 1. It is to be noted that frame 3 has mounting part 13 between opening 11 and the outer periphery. Mounting part 13 is a portion where diaphragm 8 is mounted and coupled at the time of manufacturing loud speaker 1.

Figure 2C:
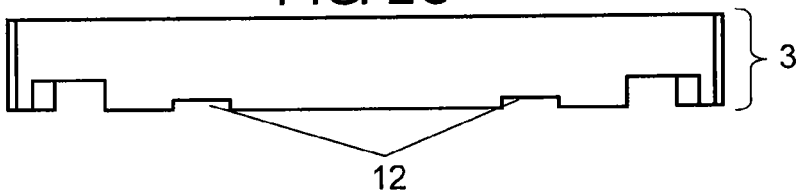
FIG. 2C is a front view of frame 3.
Figure 2D:
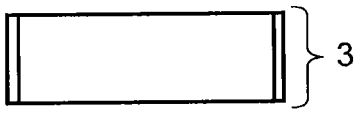
FIG. 2D is a side view of frame 3.

Further, as shown in FIGS. 2B and 2C, four lock craw locking parts 12, formed by notching parts of frame 3, are provided on the bottom surface and the long sides of frame 3. Lock craw locking part 12 is a portion to be fitted with later-mentioned lock claw 29 of protector 9, to fix protector 9 to frame 3 at the time of manufacturing loud speaker 1.

Figure 2E:
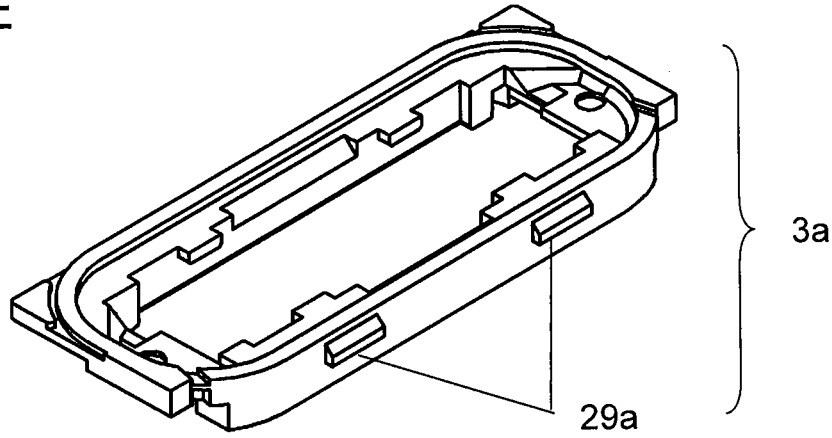
FIG. 2E is a perspective view of an outer appearance of frame 3*a* of another example.
Figure 2F:
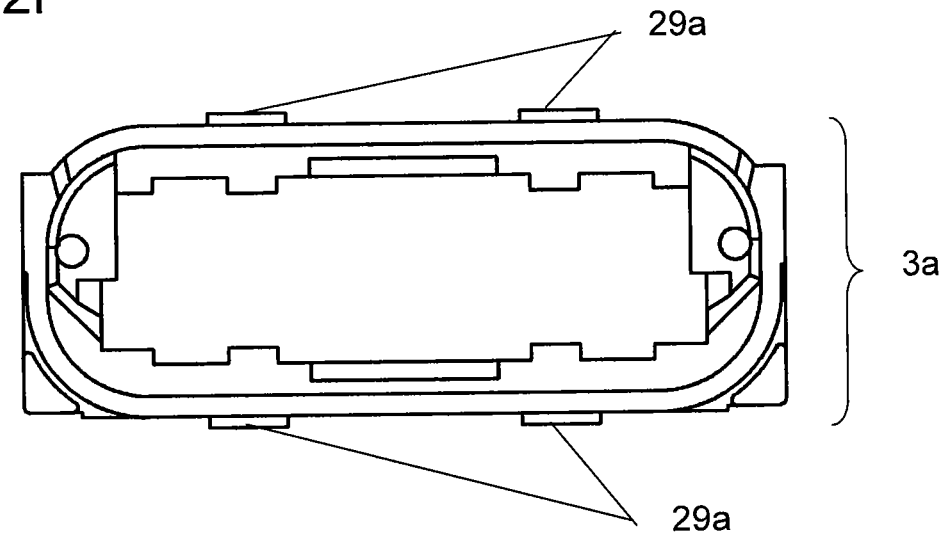
FIG. 2F is a top view of frame 3*a*.
Figure 2G:
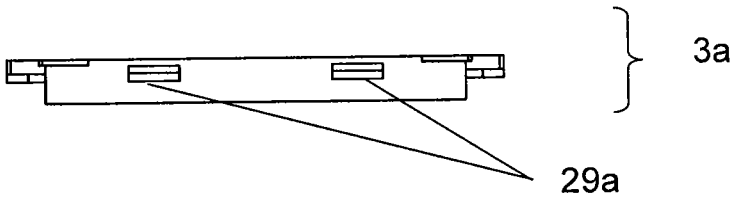
FIG. 2G is a side view of frame 3*a*.

FIGS. 2E to 2G show frame 3*a* of another example, where lock claw 29*a* has a fitting structure of another example, and is a portion fitted with later-mentioned lock craw locking part 12*a* (see FIG. 8D) of protector 9*b*, also of another example.

Figure 3A:
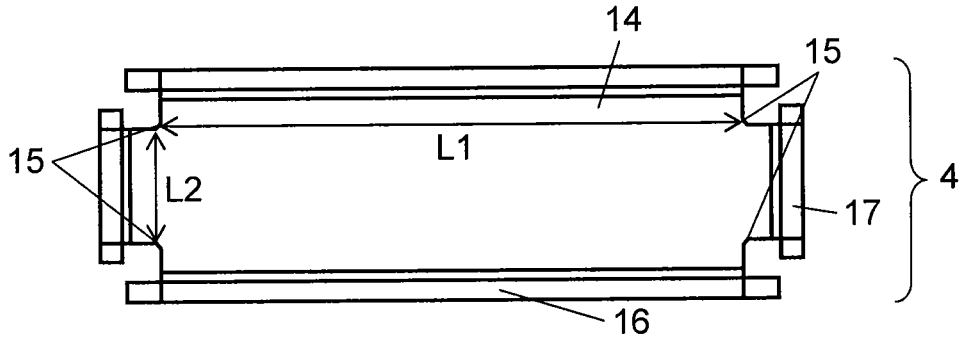
FIG. 3A is a top view of an outer appearance of yoke 4.

Next, yoke 4 is described with reference to FIGS. 3A to 3D. FIG. 3A is a top view of an outer appearance of yoke 4, FIG. 3B is a bottom view thereof, FIG. 3C is a front view thereof, and FIG. 3D is a side view thereof.

Figure 3B:
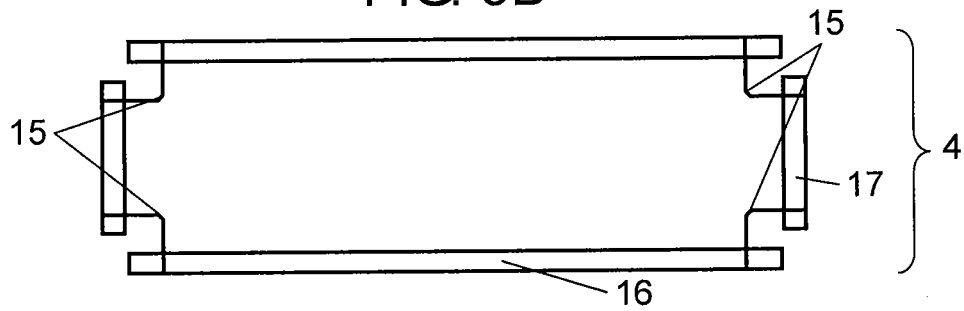
FIG. 3B is a bottom view.

Yoke 4 is made of iron or the like as a magnetic member, and bottom surface 14 is in substantially rectangular shape made up of long side portions and short side portions, as shown in FIGS. 3A and 3B. Bottom surface 14 has yoke notched part 15 at each corner part. Four yoke notched parts 15 are provided on bottom surface 14, and the most inner sides of the notched portions, namely portions closest to the center of the bottom surface of yoke 4, are in round shape.

Figure 3C:
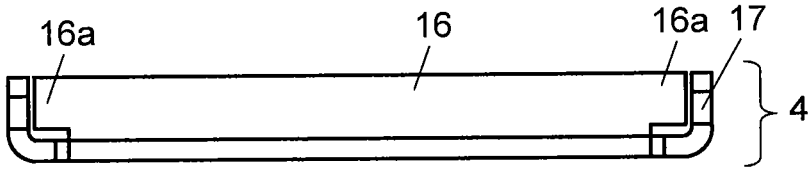
FIG. 3C is a front view.
Figure 3D:
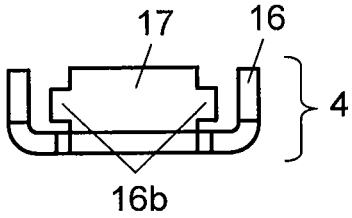
FIG. 3D is a side view.

Moreover, bottom surface 14 has long side surfaces 16 on the long sides as shown in FIG. 3C, and further has short side surfaces 17 on the short sides as shown in FIG. 3D. In other words, yoke 4 is provided with these long side surfaces 16 and short side surfaces 17, thereby to have a substantially box shape with notched corner parts, as shown in FIG. 1.

As shown in FIG. 3C, long side surface 16 has protruded surface 16*a* protruding laterally at each end of the long side. Further, short side surface 17 has protruded surface 16*b* protruding laterally at each end of the long side. In this manner, protruded surfaces 16*a* and protruded surfaces 16*b* are respectively provided on long side surface 16 and short side surface 17, thereby to increase an area of a portion to receive magnetic fluxes from magnet 5 and plate 6. This results in an increase in number of magnetic fluxes received by voice coil 7 from the magnetic circuit body, thereby allowing sufficient vertical vibration of voice coil 7 at the time of driving loud speaker 1.

Figure 4:
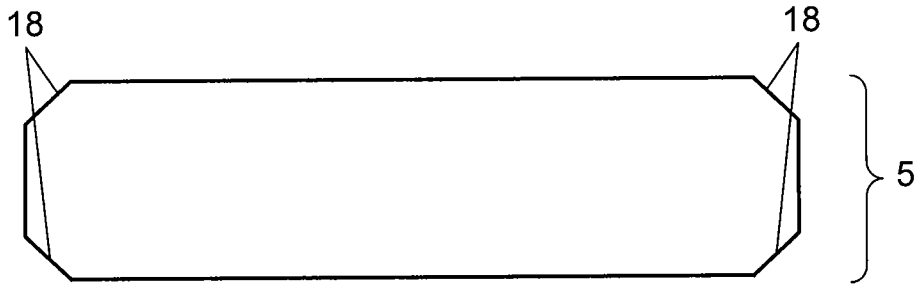
FIG. 4 is a top view of magnet 5.

Next, magnet 5 is described with reference to FIG. 4. FIG. 4 is a top view of magnet 5. It is to be noted that the upper surface and the lower surface of magnet 5 have the same shape.

As shown in FIG. 4, magnet 5 is in substantially rectangular shape made up of long side portions and short side portions. Respective corner parts of magnet 5 are configured to be notched, and magnet 5 has four magnet notched parts 18.

Figure 5A:
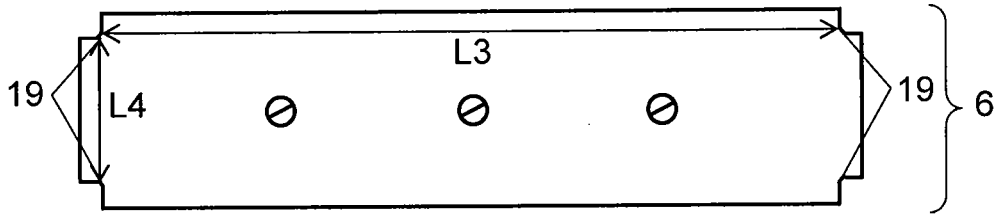
FIG. 5A is a top view of an outer appearance of plate 6.

Next, plate 6 is described with reference to FIGS. 5A and 5B. FIG. 5A is a top view of an outer appearance of plate 6, and FIG. 5B is a bottom view thereof.

Plate 6 has a substantially rectangular parallelepiped shape, and as shown in FIG. 5A, the upper surface of plate 6 is in a substantially rectangular shape made up of long side portions and short side portions. Respective corner parts of plate 6 are configured to be notched, and plate 6 has four plate notched parts 19. In plate notched part 19, the most inner side of the notched portion, namely a portion closest to the center of plate 6, is in round shape.

Figure 5B:
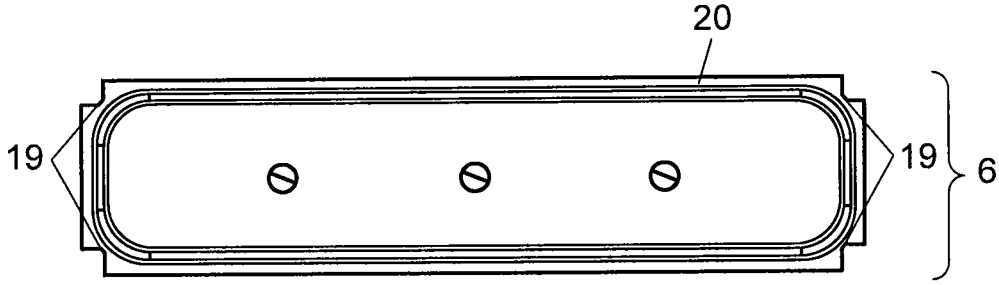
FIG. 5B is a bottom view.

As shown in FIG. 5B, the lower surface of plate 6 is in an identical shape to the upper surface of plate 6. However, on the lower surface of plate 6, track-like groove 20 is provided along the periphery thereof. At the time of attaching magnet 5 and plate 6 to each other with an adhesive, groove 20 prevents an excess adhesive from overflowing to the sides of plate 6.

It is to be noted that the long sides and the short sides of plate 6 are respectively longer than the long sides and short sides of magnet 5, and further, plate notched part 19 of plate 6 is smaller than magnet notched part 18 of magnet 5. Therefore, when plate 6 is superimposed on magnet 5 and attached thereto, the periphery of magnet 5 can be disposed inside the periphery of plate 6.

Further, a distance (L3 of FIG. 5A) between plate notched parts 19 on the long side of plate 6 is equivalent to a distance (L1 of FIG. 3A) between yoke notched parts 15 on the long side of yoke 4, and a distance (L4 of FIG. 5A) between plate notched parts 19 on the short side of plate 6 is equivalent to a distance (L2 of FIG. 3A) between yoke notched parts 15 on the short side of yoke 4. Therefore, plate 6 can be superimposed on yoke 4 such that part of plate notched part 19 and part of yoke notched part 15 at each corner part are placed on the same straight line.

Figure 6A:
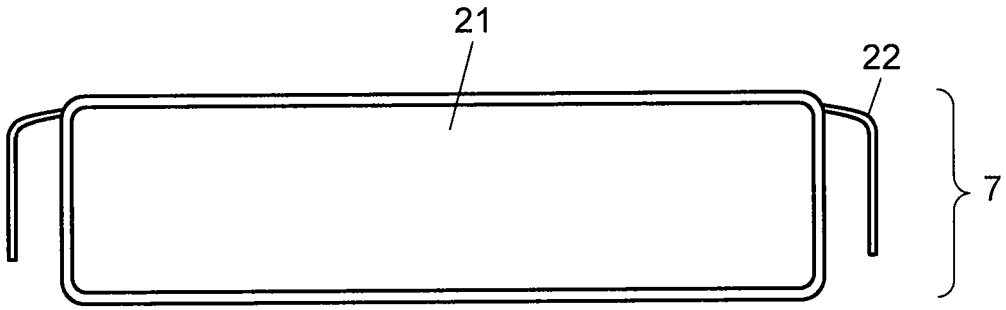
FIG. 6A is a top view of an outer appearance of voice coil 7.
Figure 6B:
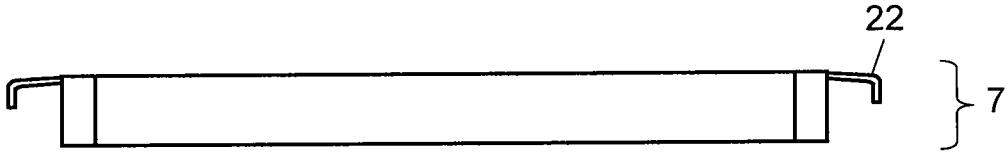
FIG. 6B is a front view.

Next, voice coil 7 is described with reference to FIGS. 6A and 6B. FIG. 6A is a top view of an outer appearance of voice coil 7, and FIG. 6B is a front view thereof.

Voice coil 7 is formed by winding one wire and formed so as to have a substantially rectangular shape with hallow part 21 in the center thereof as shown in FIG. 6A. With a long side of hollow part 21 being longer than the long sides of plate 6 and magnet 5 and a short side of hollow part 21 being longer than the short sides of plate 6 and magnet 5, it is possible to insert plate 6 and magnet 5 into hollow part 21 at the time of assembling loud speaker 1.

It is to be noted that each corner part of voice coil 7 is formed in round shape so that excessive stress load is not applied when loud speaker 1 is driven and voice coil 7 is vertically vibrated. Further, fine braided wire 22 is provided from voice coil 7 as shown in FIGS. 6A and 6B. At the time of driving loud speaker 1, an alternating current added with a voice signal is allowed to flow from the outside into voice coil 7 through this fine braided wire 22.

Figure 7A:
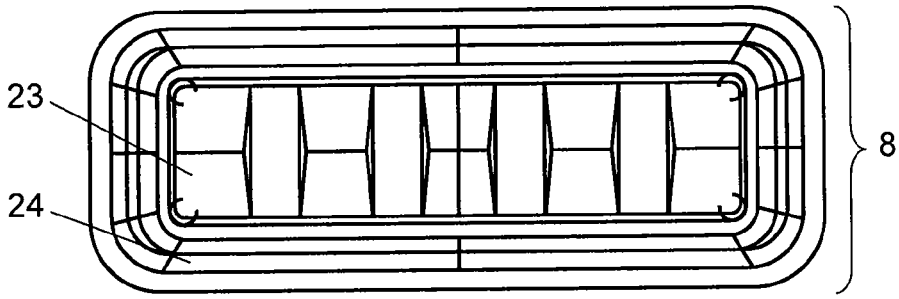
FIG. 7A is a top view of an outer appearance of diaphragm 8.

Next, diaphragm 8 is described with reference to FIGS. 7A to 7F. FIG. 7A is a top view of an outer appearance of diaphragm 8, FIG. 7B is a bottom view thereof, and FIG. 7C is a front view thereof.

Figure 7B:
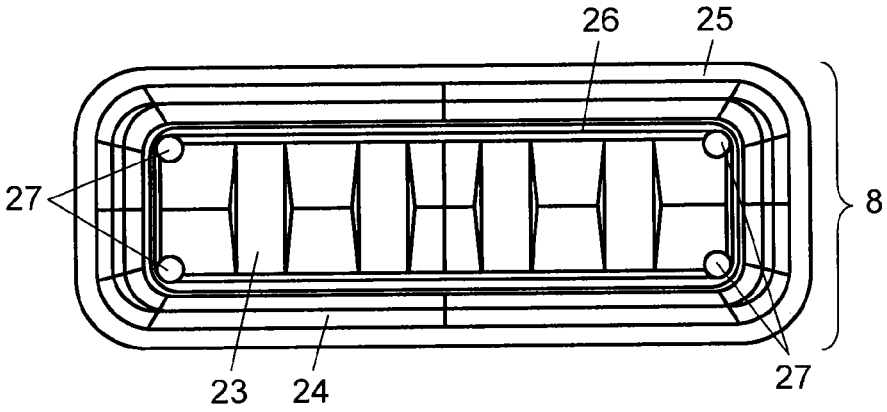
FIG. 7B is a bottom view.
Figure 7C:
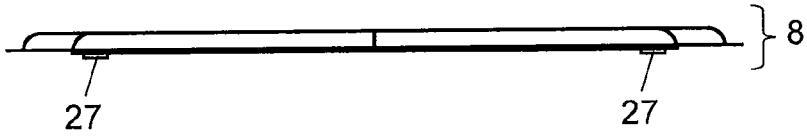
FIG. 7C is a front view.
Figure 7D:
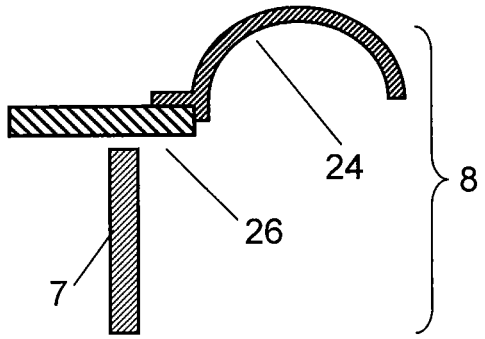
FIG. 7D is a sectional view of a voice-coil coupled portion.
Figure 7E:
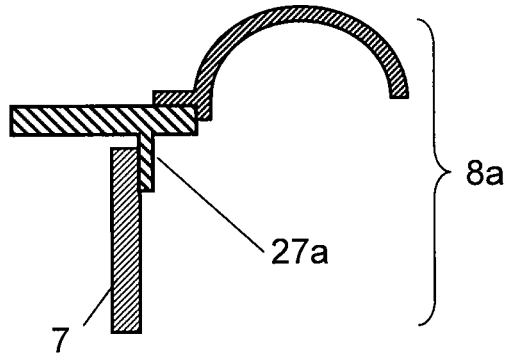
FIG. 7E is a sectional view of a voice-coil coupled portion of diaphragm 8*a* of another example.
Figure 7F:
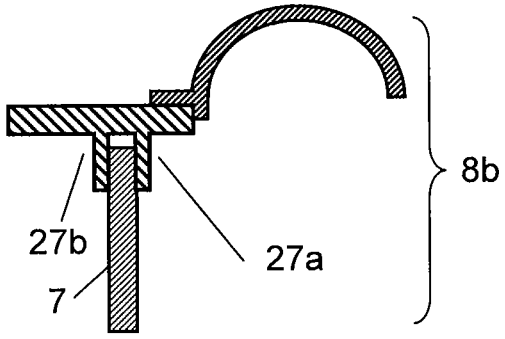
FIG. 7F is a sectional view of a voice-coil coupled portion of diaphragm 8*b* of another example.

FIG. 7D is a sectional view of a voice-coil coupled portion. FIG. 7E is a sectional view of a voice-coil coupled portion of diaphragm 8*a* of another example. FIG. 7F is a sectional view of a voice-coil coupled portion of diaphragm 8*b* of another example.

As shown in FIGS. 7A and 7B, diaphragm 8 is made up of body part 23 in substantially rectangular shape and edge part 24 coupled so as to surround body part 23. The outer peripheral portion of edge part 24 is in substantially rectangular shape, and each corner part is in round shape.

At the time of driving loud speaker 1, edge part 24 is transformed, to vertically vibrate diaphragm 8. Therefore, in order to alleviate stress load that is applied at the time of driving the loud speaker, edge part 24 is formed in a shape protruding on the side of a voice outputting direction, and being curved. It should be note that, although edge part 24 is formed in the shape protruding on the side of the voice outputting direction in the present embodiment, this is not restrictive, and for example, it may also be formed in a shape protruding in an opposite direction to the side of the vice outputting direction. Further, on the outer periphery of edge part 24, outer coupling part 25 is provided having the same shape as that of mounting part 13 provided in frame 3, and is coupled to the upper end surface of mounting part 13 of frame 3 at the time of manufacturing loud speaker 1.

Similarly, body part 23 is provided with inner coupling part 26 in the same shape as the substantially rectangular shape of voice coil 7. Inner coupling part 26 is located at a position where the upper end of voice coil 7 is coupled. It is to be noted that in the present embodiment, inner coupling part 26 simply indicates a position where voice coil 7 is coupled, and inner coupling part 26 is neither grooved shape nor protruding, but is configured to be flat with respect to the periphery thereof. However, as shown with diaphragm 8*a* of another example in FIG. 7E, protruded part 27*a* in contact with the outer side surface of voice coil 7 may also be provided. Further, as shown with diaphragm 8*b* of another example in FIG. 7F, protruded part 27*b* in contact with the inside of voice coil 7 may also be provided, or both protruded parts 27*a* and 27*b* may also be provided.

Further, on the inside and in the vicinities of the respective corner parts of inner coupling part 26 in substantially rectangular shape, four circular protruded parts 27 are provided as shown in FIGS. 7B and 7C. Protruded part 27 is provided so as to protrude in the lower side direction, i.e. on the yoke 4 side, in FIG. 7C. It is to be noted that even without the presence of protruded part 27 of diaphragm 8, the loud speaker of the present invention can be configured.

Figure 8A:
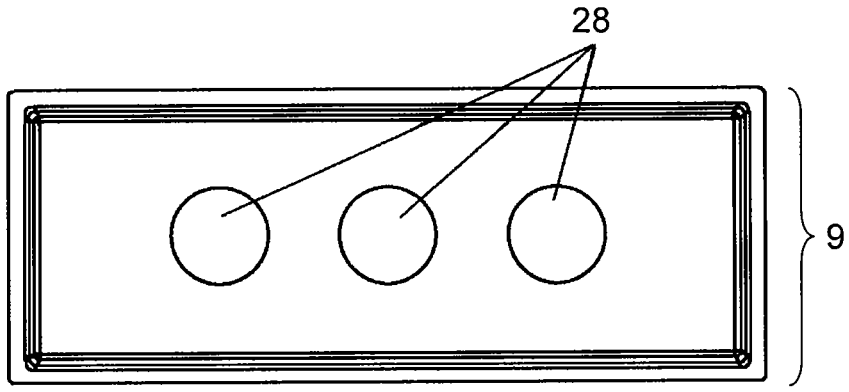
FIG. 8A is a top view of an outer appearance of protector 9.
Figure 8B:
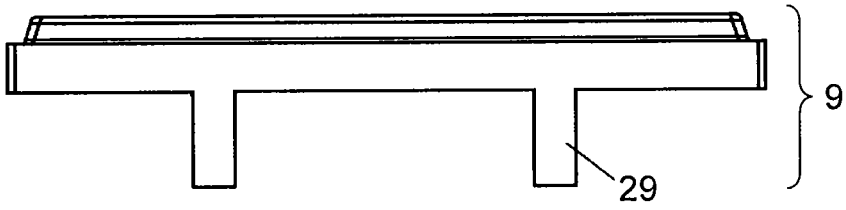
FIG. 8B is a front view.
Figure 8C:
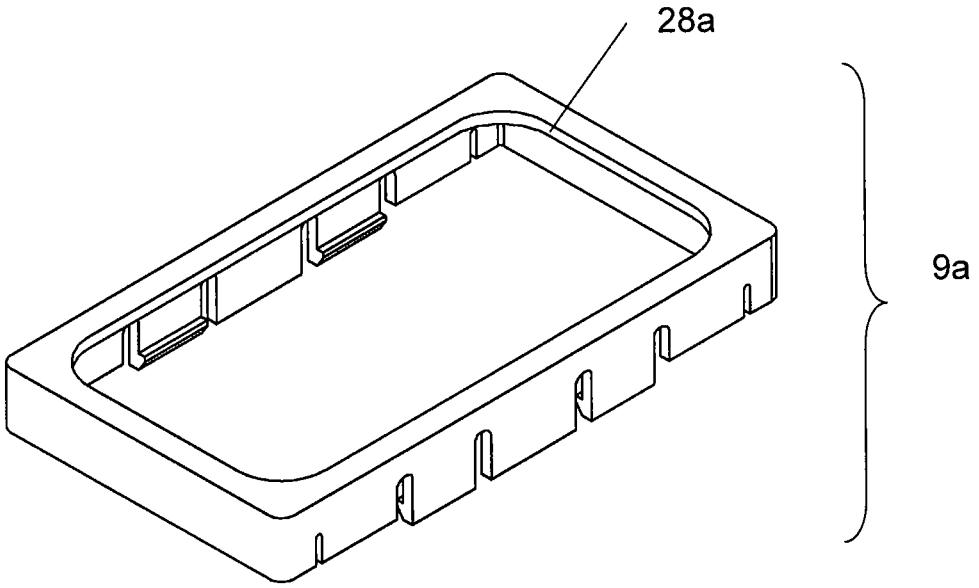
FIG. 8C is a perspective view of an outer appearance of protector 9*a* of another example.
Figure 8D:
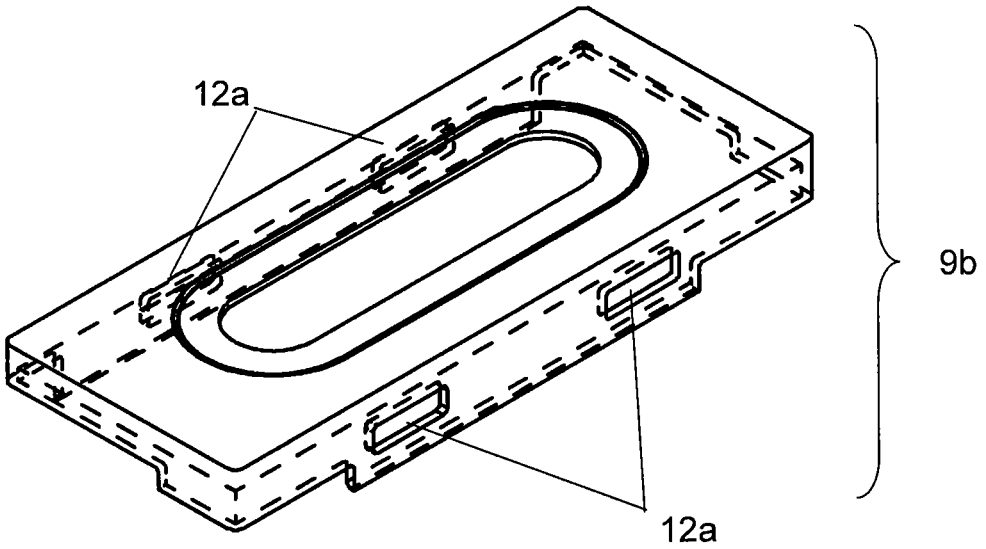
FIG. 8D is a perspective view of an outer appearance of protector 9*b* of another example.
Figure 8E:
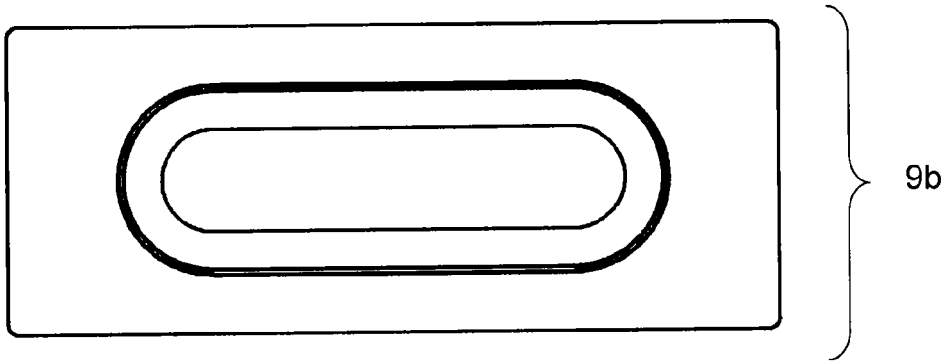
FIG. 8E is a top view of protector 9*b*.
Figure 8F:
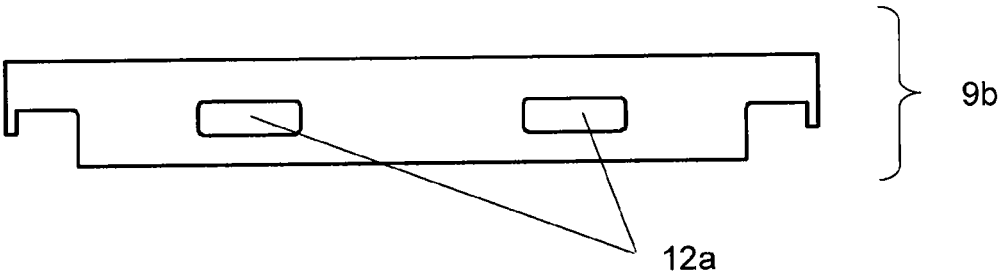
FIG. 8F is a front view of protector 9*b*.

Next, protector 9 is described with reference to FIGS. 8A to 8F. FIG. 8A is a top view of an outer appearance of protector 9, and FIG. 8B is a front view thereof. FIG. 8C is a perspective view of an outer appearance of protector 9*a* of another example. FIG. 8D is a perspective view of an outer appearance of protector 9*b* of another example. FIG. 8E is a top view of protector 9*b*. FIG. 8F is a front view of protector 9*b*.

Protector 9 is a component for protecting the constituent components of loud speaker 1, such as the magnetic circuit body and diaphragm 8, from the outside, and as shown in FIG. 8A, the upper surface of protector 9 is in substantially rectangular shape made up of long side portions and short side portions.

Further, as shown in FIG. 8A, protector 9 is provided with three circular sound output holes 28. At the time of driving loud speaker 1, sound reproduced from diaphragm 8 is emitted to the outside through this sound output hole 28. In addition, although the configuration is formed to provide three sound output holes 28 in the present embodiment, this configuration is not restrictive, and a configuration may also be formed to provide only one sound output hole 28 or a further larger number of sound output holes 28, or the way to arrange sound output holes 28 may also be changed. For example, as shown with protector 9*a* of another example in FIG. 8C, such a configuration may also be formed to provide sound output hole 28*a* opening up most of the upper surface.

Further, as shown in FIG. 8B, two lock claws 29 each are provided on each long side of protector 9, which total four lock claws 29. Lock claw 29 is fitted with lock craw locking part 12 of frame 3 at the time of manufacturing loud speaker 1.

It is to be noted that the structure is formed in the present embodiment where lock claws 29 are provided on protector 9 side and lock craw locking parts 12 are provided on the frame 3 side, to be fitted with each other, but a structure may also be formed where lock claws 29 and lock craw locking parts 12 are respectively inversely disposed, or more specifically, as shown in FIGS. 2E to 2G and FIGS. 8D to 8F, a structure may also be formed as another example where lock claws 29*a* are provided on frame 3*a* side and lock craw locking parts 12 are provided on the side surface of protector 9*b* side, to be fitted with each other.

Figure 9A:
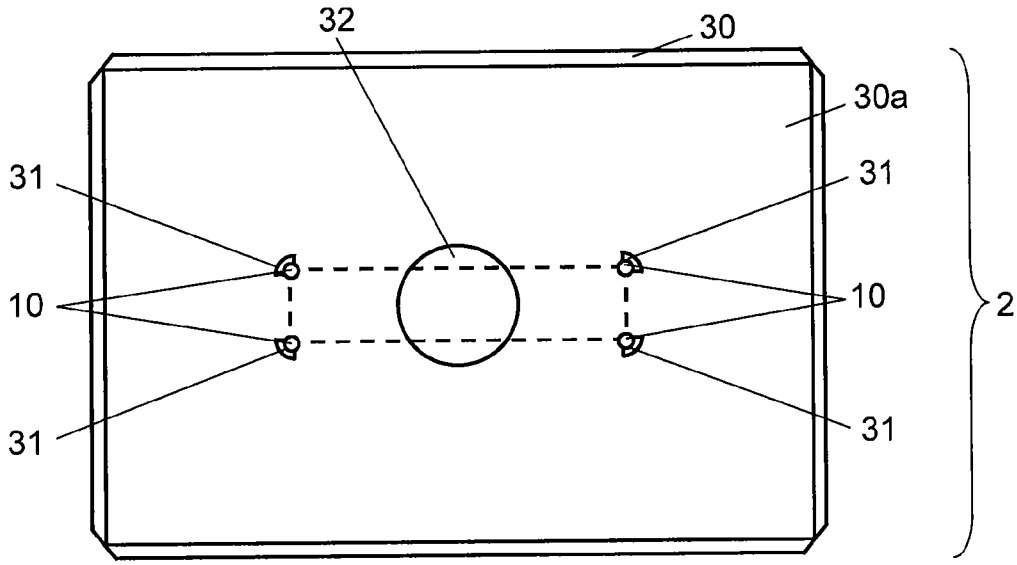
FIG. 9A is a top view of an outer appearance of jig 2.

Next, jig 2 is described with reference to FIGS. 9A to 9C. FIG. 9A is a top view of an outer appearance of jig 2, FIG. 9B is a front view thereof, and FIG. 9C is an enlarged view of guide member 10 and voice coil mounting part 31 which are provided in jig 2.

Figure 9B:
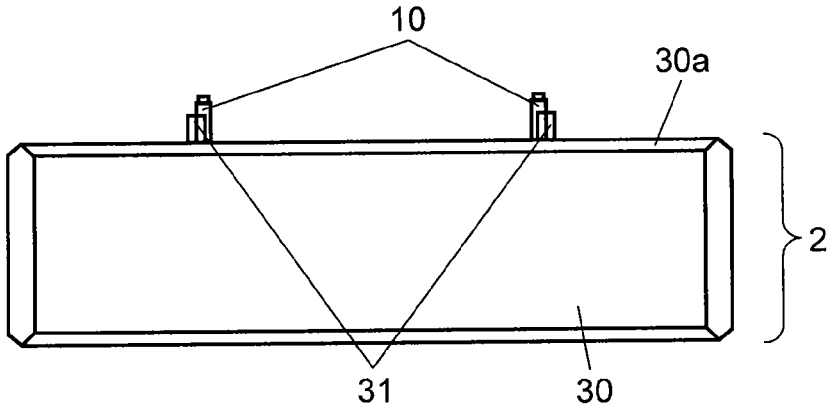
FIG. 9B is a front view.

As shown in FIGS. 9A and 9B, jig 2 is made up of basic part 30 being a substantially rectangular parallelepiped, four rod-like guide members 10 provided in the vicinity of the central part of basic part 30*a* as the upper end surface of basic part 30, and voice coil mounting parts 31 provided in the vicinities of respective guide members 10. These four guide members 10 are respectively disposed at corner parts in substantially rectangular shape, indicated by dotted lines of FIG. 9A. In other words, a shape formed by each of these four guide members is a substantially rectangular shape. It is to be noted that these guide members 10 guide the foregoing respective constitutional components at the time of manufacturing loud speaker 1.

Further, as shown in FIGS. 9A and 9B, mounting surface 30*a* is in flat shape, and magnetic body 32 is buried at the central part thereof. Although the configuration is formed in the present embodiment where part of magnetic body 32 is exposed to the outside from a portion of a circle at the center of the substantially rectangular shape which is indicated by dotted lines in FIG. 9A, this configuration is not restrictive, and a configuration may also be formed where magnetic body 32 is completely buried in jig 2 and not exposed to the outside.

Figure 9C:
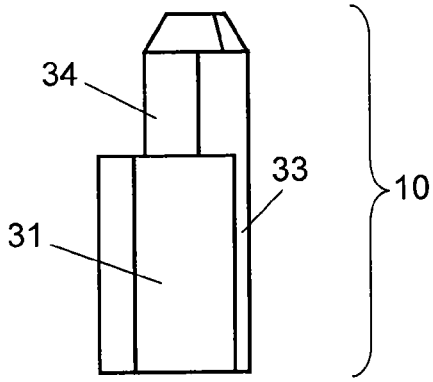
FIG. 9C is an enlarged view of guide member 10 and voice coil mounting part 31 which are provided in jig 2.

As shown in FIGS. 9B and 9C, guide member 10 is vertical to mounting surface 30*a*, and has first linear guide portion 33 and second linear guide portion 34 which are straight from the lower end to the vicinity of the upper end. First guide portion 33 is located inside the rectangular shape formed by foregoing guide members 10, and second guide portion 34 is located outside the rectangular shape formed by guide members 10. Among these two guide parts, first guide portion 33 is a portion to guide yoke 4 and plate 6, and the lower end thereof is connected to mounting surface 30*a*. Further, second guide portion 34 is a portion to guide the inner periphery of voice coil 7, and is connected with voice coil mounting part 31 for mounting voice coil 7 in the vicinity of the central part. It should be noted that, although guide member 10 is formed in cylindrical shape in the present embodiment, this is not restrictive, and any shape may also be formed so long as having a vertical linear portion with respect to mounting surface 30*a* from the lower end to the vicinity of the top end, such as a prismatic shape. However, since the possibility of damaging each constitutional component of loud speaker 1 is reduced in the case of the cylindrical shape as in the present embodiment, guide member 10 is desirably in cylindrical shape. In addition, a diameter of a tip of guide member 10 is made smaller than those of the central part and the lower end thereof, so as not to damage each constitutional component of loud speaker 1 at the time of allowing guide member 10 to guide each constitutional component. Alternatively, also with a configuration where guide member 10 is formed in cylindrical shape and the tip thereof is crimped, it is possible to prevent each constitutional component from being damaged.

Further, as shown in FIG. 9C, jig 2 is provided with voice coil mounting part 31 with the top end surface thereof being flat. At the time of manufacturing loud speaker 1, voice coil mounting part 31 is mounted with voice coil 7 on the upper end surface thereof, to hold voice coil 7 at a predetermined height. Voice coil mounting part 31 is a portion provided for the purpose of accurately disposing voice coil 7 at the predetermined height inside a magnetic gap formed by yoke 4 and plate 6, and designed so as to have a total height lower than that of guide member 10. Further, voice coil mounting part 31 is disposed outside the substantially rectangular shape indicated by the dotted lines in FIG. 9A. It is to be noted that in the present embodiment, voice coil mounting part 31 is united with guide member 10, and there is no gap between voice coil mounting part 31 and guide member 10.

Hereinafter, a manufacturing process for loud speaker 1 is described.

Figure 10:
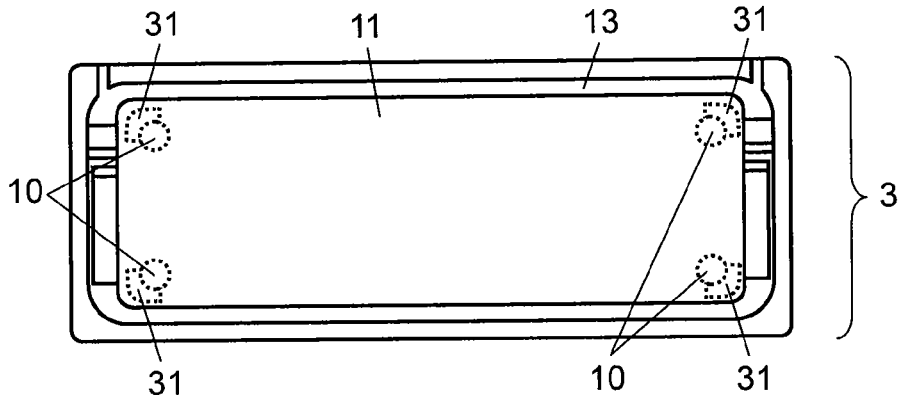
FIG. 10 is a view showing a positional relation between guide member 10 and frame 3 at the time of manufacturing.
Figure 11:
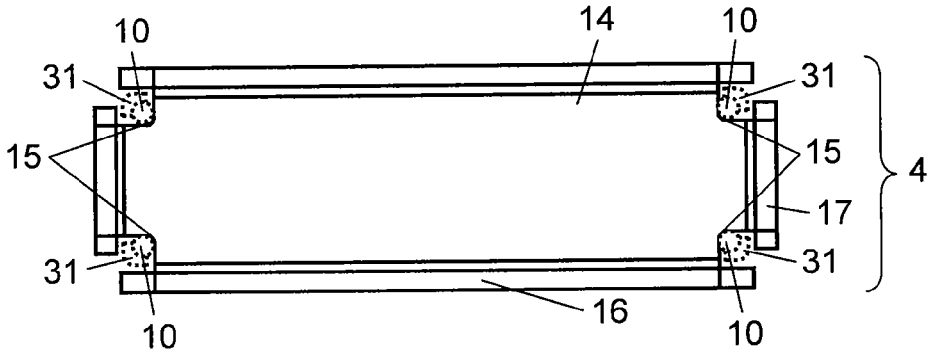
FIG. 11 is a view showing a positional relation between guide member 10 and yoke 4 at the time of manufacturing.
Figure 12:
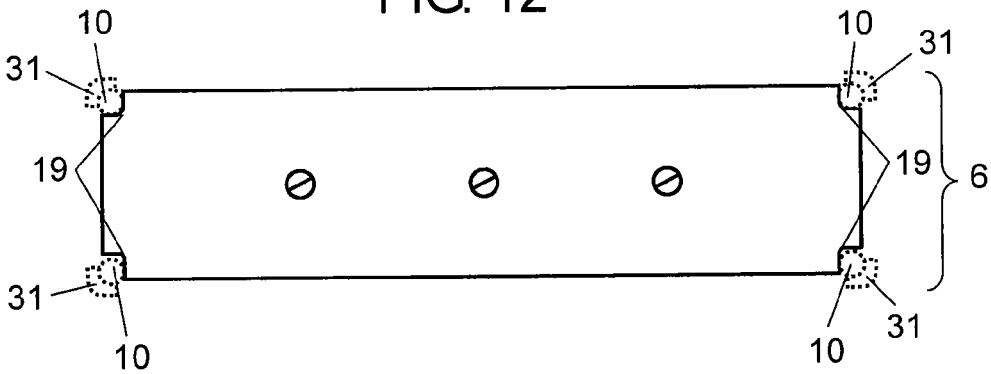
FIG. 12 is a view showing a positional relation between guide member 10 and plate 6 at the time of manufacturing.
Figure 13:
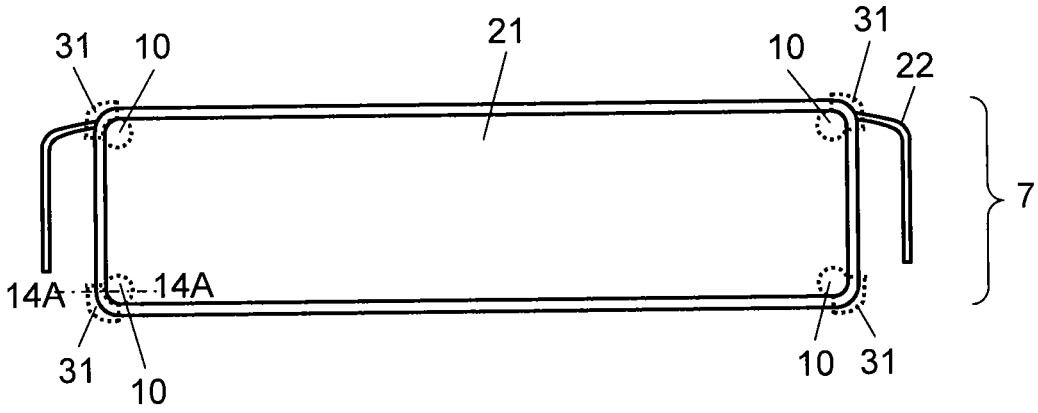
FIG. 13 is a view showing a positional relation between guide member 10 and voice coil 7 at the time of manufacturing.

FIG. 10 is a view showing a positional relation between guide member 10 and frame 3 at the time of manufacturing. FIG. 11 is a view showing a positional relation between guide member 10 and yoke 4 at the time of manufacturing. FIG. 12 is a view showing a positional relation between guide member 10 and plate 6 at the time of manufacturing. FIG. 13 is a view showing a positional relation between guide member 10 and voice coil 7 at the time of manufacturing.

A first step is a step of mounting frame 3 on jig 2. In this step, as shown in FIG. 10, frame 3 is mounted on mounting surface 30*a* of jig 2 such that guide member 10 and voice coil mounting part 31 of jig 2 are located in opening 11. Herein, in FIGS. 10 to 13, guide member 10 and voice coil mounting part 31 are indicated by dotted lines, to show a principal positional relation between each constitutional component of loud speaker 1 and guide member 10 as well as voice coil mounting part 31 in the manufacturing process. It should be noted that basic part 30 and mounting surface 30*a* are omitted, and not shown in FIGS. 10 to 13.

As shown in FIG. 10, at the time of mounting frame 3 on jig 2, four guide members 10 and voice coil mounting parts 31 are located in the vicinities of the respective corners of opening 11.

It is to be noted that in this step, frame 3 is not necessarily required to be accurately positioned with respect to mounting surface 30*a*, but may be mounted with certain accuracy. For example, there should be no problem even if the process proceeds to the next step while frame 3, guide members 10 and voice coil mounting parts 31 are in the state of being in contact with one another. This is because, at the time of coupling frame 3 and yoke 4 in a subsequent process, yoke 4 is fitted into opening 11 of frame 3, thereby allowing frame 3 to be automatically positioned with respect to yoke 4 and guide members 10.

A second step is a step of guiding yoke 4 by guide members 10, and coupling yoke 4 to frame 3.

In this step, first, as shown in FIG. 11, first guide portion 33 of each guide member 10 is brought into contact with each yoke notched part 15 of yoke 4. In this state, yoke 4 is guided in a direction of arrow A indicated in FIG. 1 along first guide portions 33, so as to be fitted into opening 11 of frame 3, mounted on mounting surface 30*a* of jig 2 in the first step. This results in coupling of yoke 4 to frame 3. It is to be noted that as described above, frame 3 is positioned with respect to yoke 4 and guide members 10 by this step.

A third step is a step of guiding plate 6 joined with magnet 5 by guide members 10, and coupling magnet 5 to yoke 4.

In performing this step, the upper surface of magnet 5 and the lower surface of plate 6 are previously attached to each other with an adhesive. At this time, plate notched part 19 of plate 6 cannot be guided by guide members 10 when part of magnet 5 extends off plate notched part 19, and thereby, at the time of the attachment, magnet 5 is attached so as not to extend off plate notched part 19. It is to be noted that, as seen from this, magnet 5 is designed so as not to extend off plate notched part 19, in such manners as to have shorter long sides and short sides than those of plate 6, or to have magnet notched part 18 larger than plate notched part 19.

Further, an adhesive for coupling to yoke 4 is previously applied on the lower surface of magnet 5.

Then, as shown in FIG. 12, each plate notched part 19 of plate 6 joined with magnet 5 is brought into the state of being in contact with first guide portion 33 of each guide member 10.

In this state, as in yoke 4 in the second step, plate 6 is guided in the direction of arrow A indicated in FIG. 1 along first guide portions 33, and the lower surface of magnet 5 joined to the lower surface of plate 6 is brought into contact with yoke 4, and attached. Herein, first guide portion 33 is in a linear shape vertical to mounting surface 30*a* of jig 2, parts of yoke notched part 15 and plate notched part 19 are located on the same straight line vertical to mounting surface 30*a*.

As thus described, the magnetic circuit body having the magnetic gap between yoke 4 and plate 6 is manufactured by the first to third steps.

A fourth step is a voice coil mounting step of guiding voice coil 7 by guide members 10, inserting voice coil 7 into the magnetic gap, and mounting voice coil 7 on voice coil mounting part 31.

In this step, first, as shown in FIG. 13, a corner portion inside voice coil 7 is brought into contact with second guide portion 34 of each guide member 10. In this state, voice coil 7 is guided in the direction of the arrow indicated in FIG. 1, along second guide portions 34. Herein, with voice coil mounting part 31 provided in jig 2, voice coil 7 is mounted on voice coil mounting part 31. Hence voice coil 7 can be held at a predetermined position without further moving to mounting surface 30*a* side. It should be noted that at this time, the upper end of voice coil 7 protrudes above the upper end of guide member 10 (the opposite side to mounting surface 30*a*), so as to be later coupled to diaphragm 8.

By this step, voice coil 7 is inserted into the magnetic gap without coming into contact with the magnetic circuit body formed in the third step. Further, with voice coil 7 held on voice coil mounting part 31 at the predetermined position, voice coil 7 is not inserted into the magnetic gap more deeply than required.

A fifth step is a voice coil coupling step of coupling diaphragm 8 to voice coil 7.

There are two methods for the fifth step.

In a first method for the fifth step, first, the adhesive is applied on mounting part 13 of frame 3 and inner coupling part 26 of diaphragm 8. Then, mounting part 13 of frame 3 and outer coupling part 25 of diaphragm 8 are attached to each other with the adhesive, to be fixed, while the upper end of voice coil 7 and inner coupling part 26 of diaphragm 8 are attached to each other with the adhesive, to be fixed.

A second method for the fifth step is described below with reference to FIGS. 14A to 14C. It should be noted that FIG. 14A is an enlarged sectional view (sectional view along 14A-14A of FIG. 13) of an essential part showing a state where voice coil 7 is mounted on voice coil mounting part 31 by the fourth step, FIG. 14B is an enlarged sectional view of an essential part in a state where protruded part 27 of diaphragm 8 is inserted into the inner periphery of voice coil 7 by the fifth step, and FIG. 14C is a rear perspective view of diaphragm 8 in the state of being connected with voice coil 7.

Figure 14A:
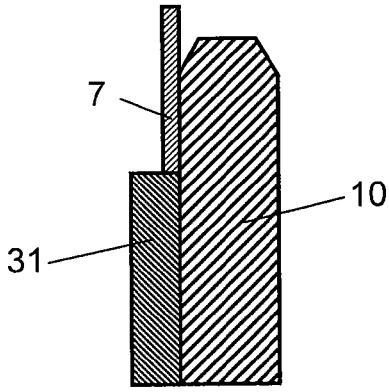
FIG. 14A is an enlarged sectional view of an essential part showing a state where voice coil 7 is mounted on voice coil mounting part 31.
Figure 14B:
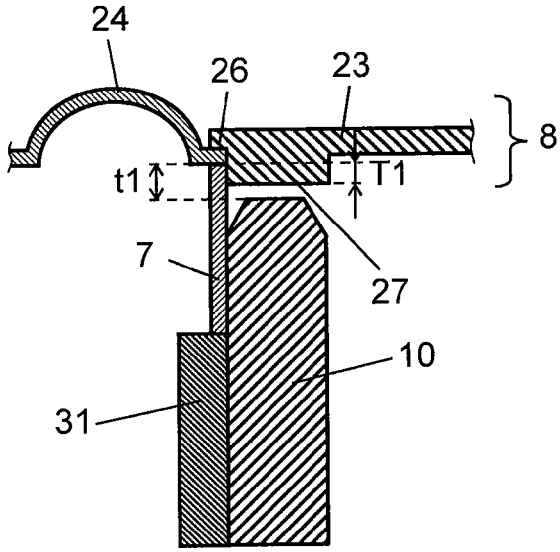
FIG. 14B is an enlarged sectional view of an essential part in a state where guide member 10 and protruded part 27 are coupled to each other.
Figure 14C:
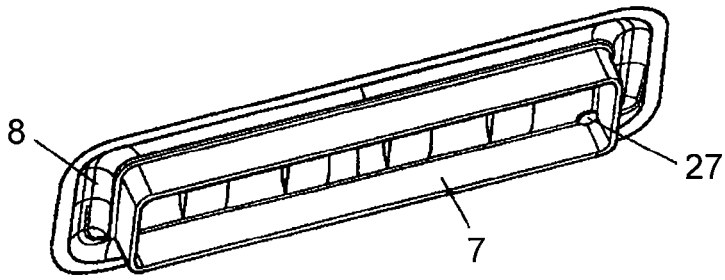
FIG. 14C is a rear perspective view of diaphragm 8 connected with voice coil 7.

As shown in FIG. 14A, by the fourth step, voice coil mounting part 31 comes into the state of being mounted with voice coil 7. At this time, the inner periphery side of voice coil 7 is in the state of being contact with guide member 10, and the end of voice coil 7 on the opposite side to voice coil mounting part 31 is in the state of protruding more in an upward direction than the tip of guide member 10, as shown in FIG. 14A.

Voice coil 7 in this state is further mounted with diaphragm 8. At this time, protruded part 27 is inserted into the inner periphery of voice coil 7 while the outer peripheral surface of protruded part 27 is held in contact with the inner peripheral surface of voice coil 7 so as to be placed therealong. At this time, with the end of voice coil 7 being in the state of protruding more in the upward direction than the tip of guide member 10 as described above, when protruded part 27 is inserted into the inner periphery of voice coil 7, the end of voice coil 7 on the opposite side to voice coil mounting part 31 necessarily comes into contact with inner coupling part 26 of diaphragm 8. This leads to a state as shown in FIG. 14B.

It is desirable herein that distance t1 by which the tip of voice coil 7 protrudes more than guide member 10 be larger than height T1 of protruded part 27 from inner coupling part 26 (t1>T1). This is because, providing a gap between the lower end of protruded part 27 and the upper end of guide member 10 can prevent the adhesive used for coupling voice coil 7 and diaphragm 8 from extending off the gap and erroneously attaching the lower end of protruded part 27 and the upper end of guide member 10.

Further, with the adhesive previously applied on the upper end of voice coil 7, voice coil 7 is coupled to inner coupling part 26 of diaphragm 8, to be fixed. This leads to a state as shown in FIG. 14C where diaphragm 8 and voice coil 7 are coupled to each other. It is to be noted that FIG. 14C is a view for showing the state of diaphragm 8 and voice coil 7 being coupled to each other, and in an actual manufacturing process, diaphragm 8 and voice coil 7 in such a coupled state are not removed from jig 2.

Further, in the fifth step, simultaneously with the coupling between diaphragm 8 and voice coil 7, outer coupling part 25 of diaphragm 8 is mounted on mounting part 13 of frame 3, and these outer coupling part 25 and mounting part 13 are attached to each other with the adhesive, to be coupled.

It is to be noted that in the foregoing first method for the fifth step, protruded part 27 of diaphragm 8 is not necessarily required.

A sixth step is a step of coupling protector 9 to frame 3. In this step, four lock claws 29 provided in protector 9 are hooked in respective corresponding lock craw locking parts 12. Thereby, protector 9 is mounted on frame 3. Further, frame 3 and protector 9 are joined to each other with the adhesive, to be fixed.

A seventh step is a step of extracting loud speaker 1 in the state up to the sixth step from jig 2.

In this step, loud speaker 1 in the state up to the sixth step is moved in a direction opposite to the arrow of FIG. 1. This can result in extraction of loud speaker 1 from jig 2.

Figure 15A:
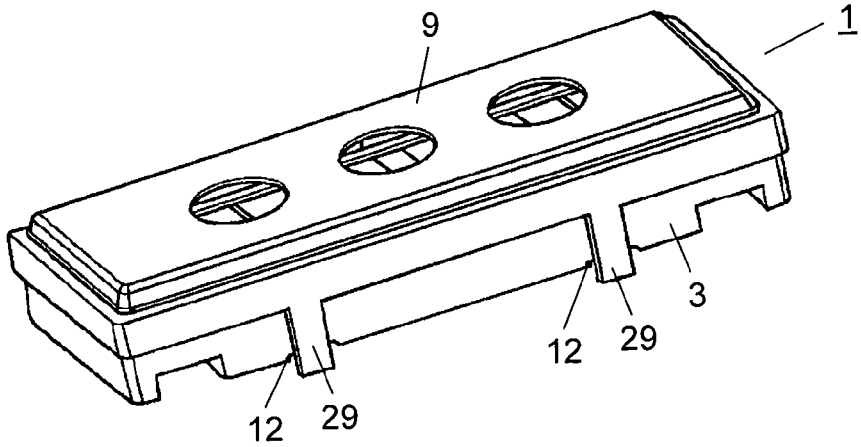
FIG. 15A is a perspective view of loud speaker 1.
Figure 15B:
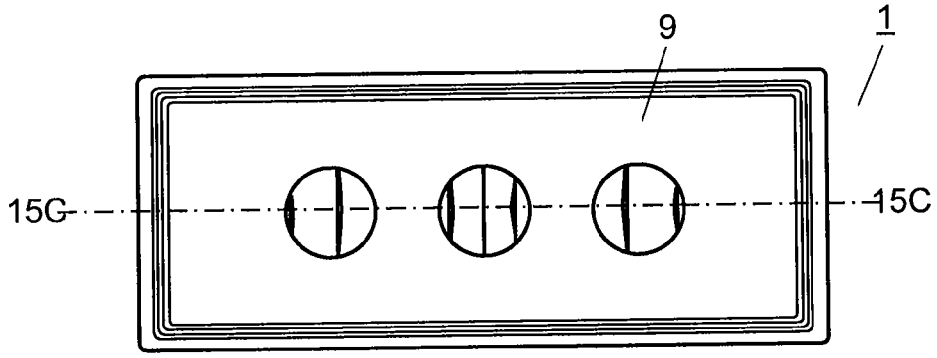
FIG. 15B is a top view of loud speaker 1.
Figure 15C:
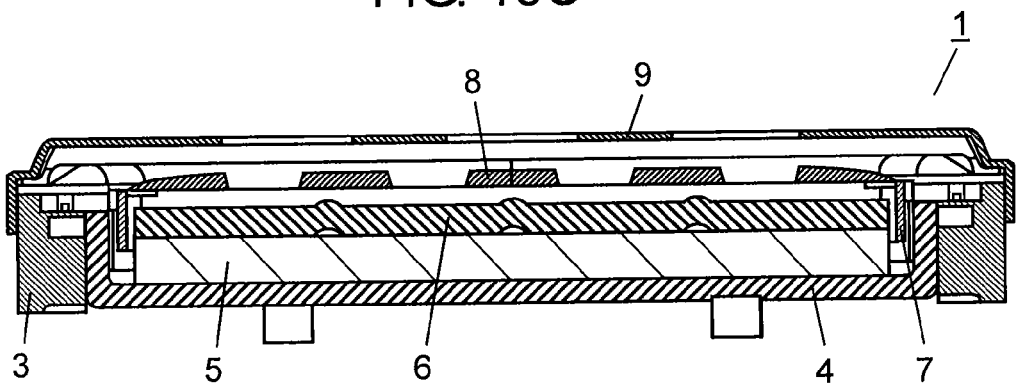
FIG. 15C is a sectional view of loud speaker 1 along dashed line 15C-15C of FIG. 15B.

With the above steps passed through, loud speaker 1 shown in FIGS. 15A to 15C is completed. Herein, FIG. 15A is a perspective view of loud speaker 1, FIG. 15B is a top view of loud speaker 1, and FIG. 15C is a sectional view of loud speaker 1 along dashed line 15C-15C of FIG. 15B.

As shown in FIG. 15C, voice coil 7 is in the state of being inserted in the magnetic gap between yoke 4 and plate 6 without being in contact with the other constitutional components, and does not come into contact with the magnetic circuit body also at the time of driving loud speaker 1. Therefore, loud speaker 1 of the present invention, configured and manufactured in such a manner, has excellent reliability.

Figure 16A:
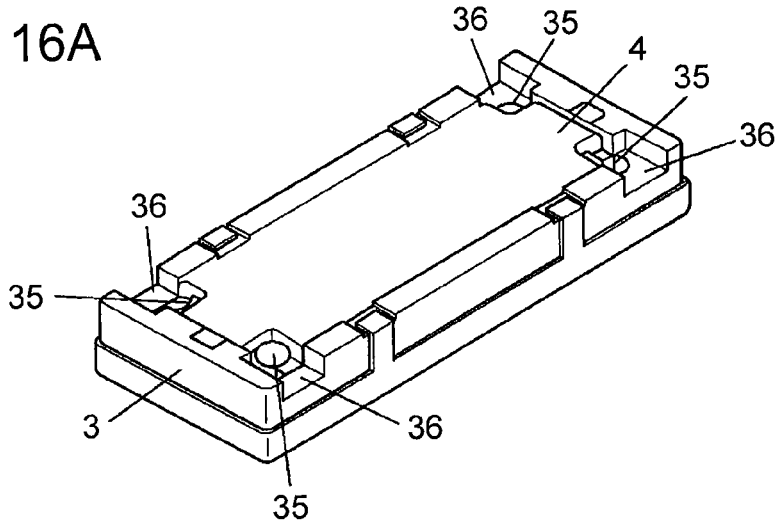
FIG. 16A is a rear perspective view of loud speaker 1 of the present embodiment.
Figure 16B:
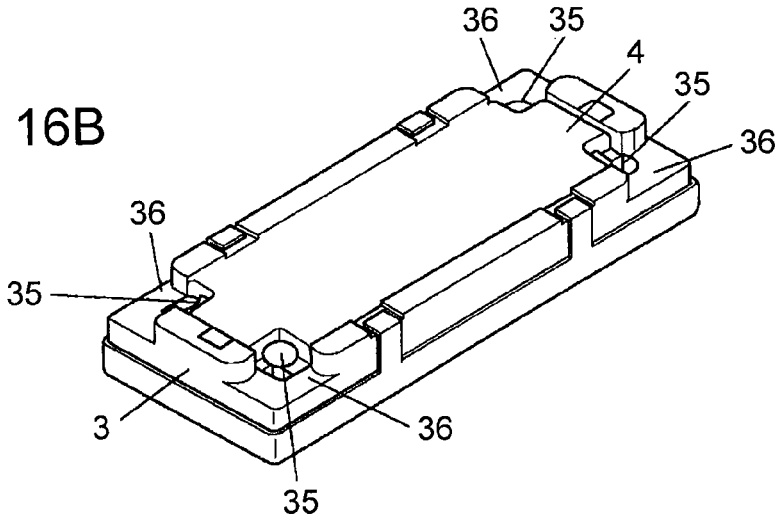
FIG. 16B is a rear perspective view of a modified example of loud speaker 1 of the present embodiment.

Herein, FIG. 16A is a rear perspective view of loud speaker 1 of the present embodiment, and FIG. 16B is a rear perspective view of a modified example of loud speaker 1 of the present embodiment.

As shown in FIG. 16A, loud speaker 1 in the present embodiment has holes 35 penetrating from the bottom surface of yoke 4 to the lower part of diaphragm 8 since being manufactured using linear guide members 10. Further, notch 36 is provided in frame 3 on the side part of each penetrating hole 35. Therefore, in loud speaker 1 in the present embodiment, even when the entire bottom surface of yoke 4 as the rear surface is joined to a substrate, air on the rear surface of diaphragm 8 is allowed to escape outside of loud speaker 1 through these penetrating holes 35 and notches 36. Consequently, loud speaker 1 of the present embodiment is not required to be provided with a spacer between the substrate and loud speaker 1 for allowing the air on the rear surface of diaphragm 8 to escape outside, and can thereby be reduced in thickness.

Further, as shown in FIG. 16B, when notch 36 is formed into taper shape expanding toward the outer periphery of frame 3, it is possible to prevent generation of wind noise at the time of allowing the air on the rear-surface of diaphragm 8 to escape outside.

Hereinafter, effects of loud speaker 1 of the present embodiment are described.

First, according to the structure of loud speaker 1 in the present embodiment, it is possible to improve the yield at the time of manufacturing loud speaker 1.

This is due to provision of protruded part 27 in diaphragm 8 in loud speaker 1.

Specifically, at the time of manufacturing loud speaker 1, the outer peripheral surface of protruded part 27 provided in diaphragm 8 is inserted into the inner periphery of voice coil 7 such that the outer peripheral surface of protruded part 27 is placed along the inner peripheral surface of voice coil 7. It is thereby possible to accurately position voice coil 7 mounted on voice coil mounting part 31 with respect to a predetermined position of the diaphragm, resulting in accurate coupling of voice coil 7 to diaphragm 8. In this manner, at the time of driving loud speaker 1, voice coil 7 accurately centered with respect to diaphragm 8 accurately vibrates vertically inside the magnetic gap without being rolled.

Therefore, according to the configuration of loud speaker 1 of the present embodiment, it is possible to reduce the possibility of voice coil 7 coming into contact with yoke 4 and plate 6, so as to improve the yield at the time of manufacturing loud speaker 1.

It should be noted that in the present embodiment, when protruded part 27 is inserted into the inner periphery of voice coil 7, four protruded parts 27 provided at the respective corner parts of diaphragm 8 are in contact with the respective corner parts of voice coil 7, thereby further enhancing the accuracy in poisoning of voice coil 7 with respect to diaphragm 8.

Further, the configuration is formed where the tip of protruded part 27 and the tip of guide member 10 are not in contact with each other at the time of coupling of voice coil 7 to diaphragm 8, thereby preventing an excess adhesive from adhering to guide member 10 to cause erroneous attachment between guide member 10 and diaphragm 8. With this configuration, it is possible to further improve the yield at the time of manufacturing loud speaker 1.

It is to be noted that in the method for manufacturing loud speaker 1 by use of one jig 2 according to the present embodiment, no jig other than jig 2 is required to be used, and loud speaker 1 can be manufactured only with one jig. In other words, in the conventional manufacturing method, two jigs or more than two jigs are required to be used, which takes labor, whereas by use of jig 2 of the present embodiment, there is an effect to manufacture the magnetic circuit body portion of loud speaker 1 without taking such labor. Further, by use of jig 2 of the present embodiment, it is possible to manufacture loud speaker 1 only by sequentially loading the constitutional components of loud speaker 1, so as to make the process less wasteful and thus improve manufacturing efficiency.

Further, it is desirable to provide protruded part 27 of diaphragm 8 in the vicinity of each corner part of inner coupling part 26 as a connected position with voice coil 7. When protruded part 27 is provided at each corner part, it is possible to prevent displacement of diaphragm 8 in a horizontal direction at the time of coupling diaphragm 8 to voice coil 7. This is because, as compared with the case of providing protruded part 27 in the vicinity of the center of the long side, or in the vicinity of the center of the short side, of inner coupling part 26, voice coil 7 can be more accurately positioned with respect to diaphragm 8. Especially in loud speaker 1 of the present embodiment, protruded part 27 is in the state of being in contact with the inner peripheral surface of voice coil 7 at each corner part, and by friction force in a shearing direction of the outer peripheral surface of protruded part 27 and the inner peripheral surface of voice coil 7, voice coil 7 has come into the state of being resistant to pealing from diaphragm 8. Therefore, loud speaker 1 of the present embodiment is excellent in coupling strength between voice coil 7 and diaphragm 8.

Further, yoke notched part 15 of yoke 4, plate notched part 19 of plate 6 and protruded part 27 are desirably disposed on the same line vertical to the bottom surface of yoke 4.

With this configuration, it is possible to manufacture loud speaker 1 only by loading each constitutional component by use of linear guide members 10 provided in jig 2 as described above, so as to manufacture loud speaker 1 with excellent productivity efficiency.

Further, in the fourth step as the step of mounting the voice coil, the end of voice coil 7, mounted on voice coil mounting part 31, on the opposite side to voice coil mounting part 31 desirably protrudes more than the tip of guide member 10.

With this configuration, it is possible to couple voice coil 7 to diaphragm 8 at the time of inserting protruded part 27 inside voice coil 7, without the upper end of guide member 10 and the lower end of protruded part 27 coming into contact with each other.

Further, as in the foregoing manufacturing process, it is desirable to provide, before the fourth step, the first step of mounting frame 3 on jig 2, the second step of guiding part of yoke notched part 15 provided in yoke 4 by guide members 10 of jig 2 and coupling yoke 4 to frame 3, and the third step of guiding part of plate notched part 19 provided in plate 6 joined with magnet 5 by guide members 10 of jig 2 and coupling magnet 5 to yoke 4.

With these steps provided, in the manufacturing method of the present embodiment, it is possible to manufacture loud speaker 1 only by loading each constitutional component by use of one jig 2, so as to further accurately position voice coil 7 with respect to diaphragm 8, while accurately inserting voice coil 7 inside the magnetic gap.

Moreover, although magnet 5 is previously brought into the state of being attached to plate 6 in the third step in the present embodiment, this is not restrictive, and loud speaker 1 can be manufactured without previous attachment of magnet 5 to plate 6.

Figure 17:
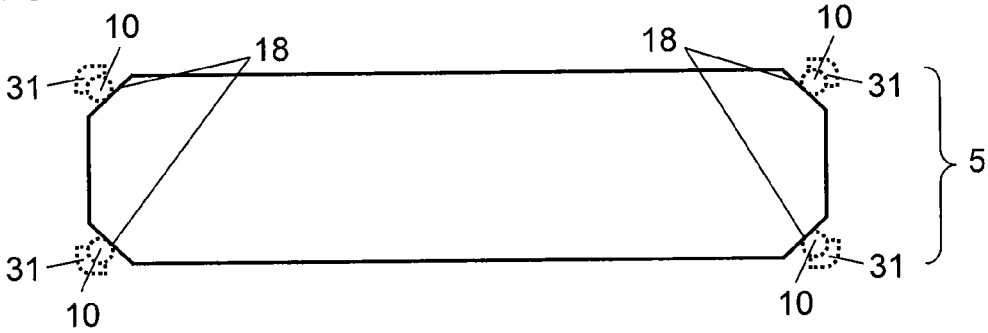
FIG. 17 is a view showing a positional relation between magnet 5 and guide member 10 in a manufacturing method in a modified example of the present invention.
Figure 18A:
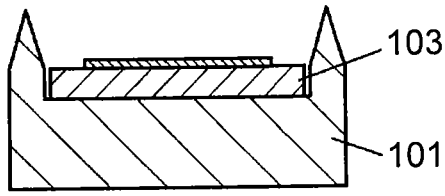
FIG. 18A is a view showing a conventional loud speaker manufacturing method.
Figure 18B:
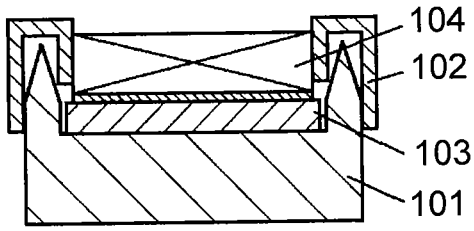
FIG. 18B is a view showing the conventional loud speaker manufacturing method.
Figure 18C:
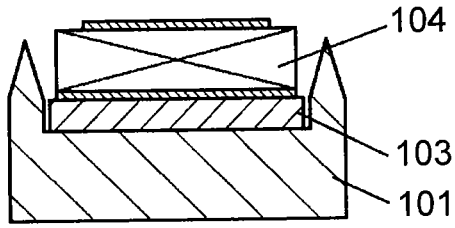
FIG. 18C is a view showing the conventional loud speaker manufacturing method.
Figure 18D:
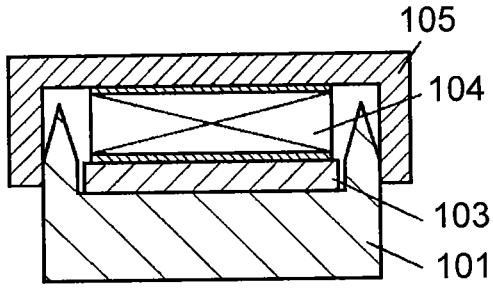
FIG. 18D is a view showing the conventional loud speaker manufacturing method.

FIG. 17 is a view showing a positional relation between magnet 5 and guide member 10 in a manufacturing method in a modified example of the present invention. After the second step, as shown in FIG. 17, magnet notched part 18 of magnet 5, previously applied with an adhesive for attachment with yoke 4, is brought into contact with first guide portion 33 of guide member 10, and from this state, magnet 5 is moved in the direction of the arrow of FIG. 1. Magnet 5 and yoke 4 are then brought into contact and attached with each other, and thereafter, plate 6 is moved in the direction of the arrow of FIG. 1 by guide members 10, and attached to magnet 5, whereby loud speaker 1 as one manufactured in the same process as above can be manufactured.

It is to be noted that in the case of previously attaching magnet 5 to the plate, there is no need for notching the corner parts of magnet 5, which is advantageous in facilitating processing of magnet 5.

In addition, it is desirable that the lower end of first guide portion 33 be connected to the mounting surface, and the lower end of second guide portion 34 be connected to the upper end surface of voice coil mounting part 31.

Herein, assuming that voice coil mounting part 31 and guide member 10 are different units, voice coil 7 is supposed to be not placed on voice coil mounting part 31, and fall into the gap between voice coil mounting part 31 and guide member 10.

On the other hand, when a configuration is formed as in the present embodiment where voice coil mounting part 31 and guide member 10 are united with each other and the lower end of second guide portion 34 is connected to the upper end surface of voice coil mounting part 31, voice coil 7 can be reliably mounted on the upper end surface of voice coil mounting part 31.

Further, magnetic body 32 is desirably buried inside jig 2.

This is because burying magnetic body 32 in jig 2 allows firm fixation of yoke 4 and magnet 5 as metal onto jig 2. Consequently, it is possible to prevent the constitutional components of loud speaker 1 from coming off guide member 10 by some impetus during the manufacturing of loud speaker 1, so as to further enhance the production efficiency of loud speaker 1. Especially when magnetic body 32 is buried in the vicinity of the central part of the substantially rectangular shape formed by the four guide members, the effect thereof becomes more obvious.

As thus described, according to the configuration of loud speaker 1 of the present embodiment, it is possible to reduce the possibility of voice coil 7 coming into contact with plate 6 and yoke 4 at the time of driving loud speaker 1, so as to improve the yield at the time of manufacturing loud speaker 1.

Industrial Applicability

According to a configuration of and a manufacturing method for a loud speaker of the present invention, a yield at the time of manufacturing the loud speaker can be improved. Moreover, the loud speaker of the present invention can accurately vibrate vertically even in a magnetic gap having been narrowed, thereby to be suitably adopted to small-sized electronic devices such as mobile phones.

REFERENCE MARKS IN THE DRAWINGS

1 Loud speaker
2 Jig
3 Frame
3*a* Frame of another example
4 Yoke
5 Magnet
6 Plate
7 Voice coil
8 Diaphragm
9 Protector
9*a* Protector of another example
9*b* Protector of another example
10 Guide member
11 Opening
12 Lock craw locking part
12*a* Lock craw locking part of another example
13 Mounting part
14 Bottom surface
15 Yoke notched part
16 Long side surface
16*a* Protruded surface
16*b* Protruded surface
17 Short side surface
18 Magnet notched part
19 Plate notched part
20 Groove
21 Hollow part
22 Fine braided wire
23 Body part
24 Edge part
25 Outer coupling part
26 Inner coupling part
27 Protruded part
27*a* Protruded part of another example
27*b* Protruded part of another example
28 Sound output hole
28*a* Sound output hole of another example
29 Lock claw
29*a* Lock claw of another example
30 Basic part
30*a* Mounting surface

31 Voice coil mounting part
32 Magnetic body
33 First guide portion
34 Second guide portion
35 Hole
36 Notch

The invention claimed is:

1. A loud speaker manufacturing method, for which a jig provided with a guide member having a linear guide portion is used, the method comprising the steps of:

mounting a frame on the jig;

guiding part of a yoke notched part provided in a yoke by the guide member of the jig, and coupling the yoke to the frame; and guiding part of a plate notched part provided in a plate joined with a magnet by the guide member of the jig, and coupling the magnet to the yoke.

2. The loud speaker manufacturing method according to claim 1, wherein the guide member further having a voice coil mounting part for mounting a voice coil, and wherein the method further comprises:

a voice coil mounting step of guiding an inner periphery of the voice coil by the guide member, and mounting the voice coil on the voice coil mounting part of the jig; and then a voice coil coupling step of coupling the voice coil to a predetermined position of a diaphragm.

3. A loud speaker manufacturing method, for which a jig provided with a guide member having a linear guide portion is used, the method comprising the steps of:

mounting a frame on the jig;

guiding part of a yoke notched part provided in a yoke by the guide member of the jig, and coupling the yoke to the frame;

guiding part of a magnet notched part provided in a magnet by the guide member of the jig, and coupling the magnet to the yoke; and guiding part of a plate notched part provided in a plate by the guide member of the jig, and coupling the plate to the magnet.

4. The loud speaker manufacturing method according to claim 3, wherein the guide member further having a voice coil mounting part for mounting a voice coil, and wherein the method further comprises:

a voice coil mounting step of guiding an inner periphery of the voice coil by the guide member, and mounting the voice coil on the voice coil mounting part of the jig; and then a voice coil coupling step of coupling the voice coil to a predetermined position of a diaphragm.

5. A jig, used for manufacturing a loud speaker comprising:

a frame having an opening;

a yoke coupled to an inner periphery of the frame, and having a yoke notched part;

a magnet coupled to a bottom center of the yoke;

a plate coupled to a surface of the magnet on an opposite side to a coupled surface to the yoke, and having a plate notched part;

a diaphragm with an outer periphery thereof coupled to the frame; and a voice coil, which is coupled to a bottom surface of the diaphragm, and part of which is disposed inside a magnetic gap between the yoke and the plate, wherein the jig includes a guide member having a linear first guide portion which guides the yoke notched part and the plate notched part.

6. The jib according to claim 5, wherein the magnet has a magnet notched part, and the first guide portion of the guide member guides the yoke notched part, the plate notched part and the magnet notched part.

7. The jig according to claim 5, wherein the guide member further has a linear second guide portion which is different from the first guide portion, and the second guide portion guides an inner periphery of the voice coil.

* * * * *